US008739582B2

(12) United States Patent
Diesing

(10) Patent No.: US 8,739,582 B2
(45) Date of Patent: Jun. 3, 2014

(54) LOCKING ARRANGEMENT

(75) Inventor: Michael Diesing, Wetter (DE)

(73) Assignee: ABUS August Bremicker Soehne KG, Wetter-Volmarstein (DE)

( * ) Notice: Subject to any disclaimer, the term of this patent is extended or adjusted under 35 U.S.C. 154(b) by 612 days.

(21) Appl. No.: 12/366,104

(22) Filed: Feb. 5, 2009

(65) Prior Publication Data

US 2009/0199602 A1 Aug. 13, 2009

(30) Foreign Application Priority Data

Feb. 7, 2008 (EP) ..... 08002279

(51) Int. Cl.
*E05B 67/38* (2006.01)

(52) U.S. Cl.
USPC ..... 70/55; 70/52; 70/54; 70/56; 70/416; 70/417; 70/448

(58) Field of Classification Search
USPC ..... 70/52, 54–56, 416, 417, 448
See application file for complete search history.

(56) References Cited

U.S. PATENT DOCUMENTS

| | | | | |
|---|---|---|---|---|
| 1,039,953 | A * | 10/1912 | Kalivoda | 292/48 |
| D217,114 | S | 4/1970 | Bremicker et al. | |
| 4,157,653 | A * | 6/1979 | Dohanyos | 70/417 |
| 4,263,795 | A * | 4/1981 | Van Gompel | 70/99 |
| 4,745,783 | A * | 5/1988 | Poe | 70/2 |
| 4,761,975 | A * | 8/1988 | Kachnowski et al. | 70/232 |
| 4,843,845 | A | 7/1989 | Poe | |
| 4,972,689 | A * | 11/1990 | Anderson | 70/56 |
| 5,737,946 | A * | 4/1998 | Sole et al. | 70/54 |
| 5,743,118 | A * | 4/1998 | Anderson | 70/56 |

(Continued)

FOREIGN PATENT DOCUMENTS

| | | |
|---|---|---|
| DE | 1033 087 | 6/1958 |
| GB | 2 419 156 | 4/2006 |
| WO | 92/19833 | 11/1992 |
| WO | 2006/124037 | 11/2006 |

OTHER PUBLICATIONS

Communication (and translation) from European Patent Office.

(Continued)

*Primary Examiner* — Lloyd Gall
*Assistant Examiner* — Ifeolu Adeboyejo
(74) *Attorney, Agent, or Firm* — Dickinson Wright PLLC

(57) ABSTRACT

A locking arrangement for the latching of a door to a counterpart has an upper part and a lower part. The upper part has at least one base section, a first side section which is angled with respect to the base section, a cover section which is angled with respect to the first side section, and a securing section which is angled with respect to the cover section and has a securing opening. The lower part has at least one base section and a securing section which is angled with respect to the base section of the lower part and has a securing opening. A holding means for the holding of a hoop lock is provided at the upper part or at the lower part. The upper part and the lower part can be positioned in a position of use relative to one another such that the securing opening of the upper part and the securing opening of the lower part are arranged in alignment to be able to secure the two securing sections to one another by means of a lock hoop. The cover section of the upper part has a key opening for a front-side introduction of a key.

33 Claims, 4 Drawing Sheets

(56) References Cited

U.S. PATENT DOCUMENTS

Figure 1A:
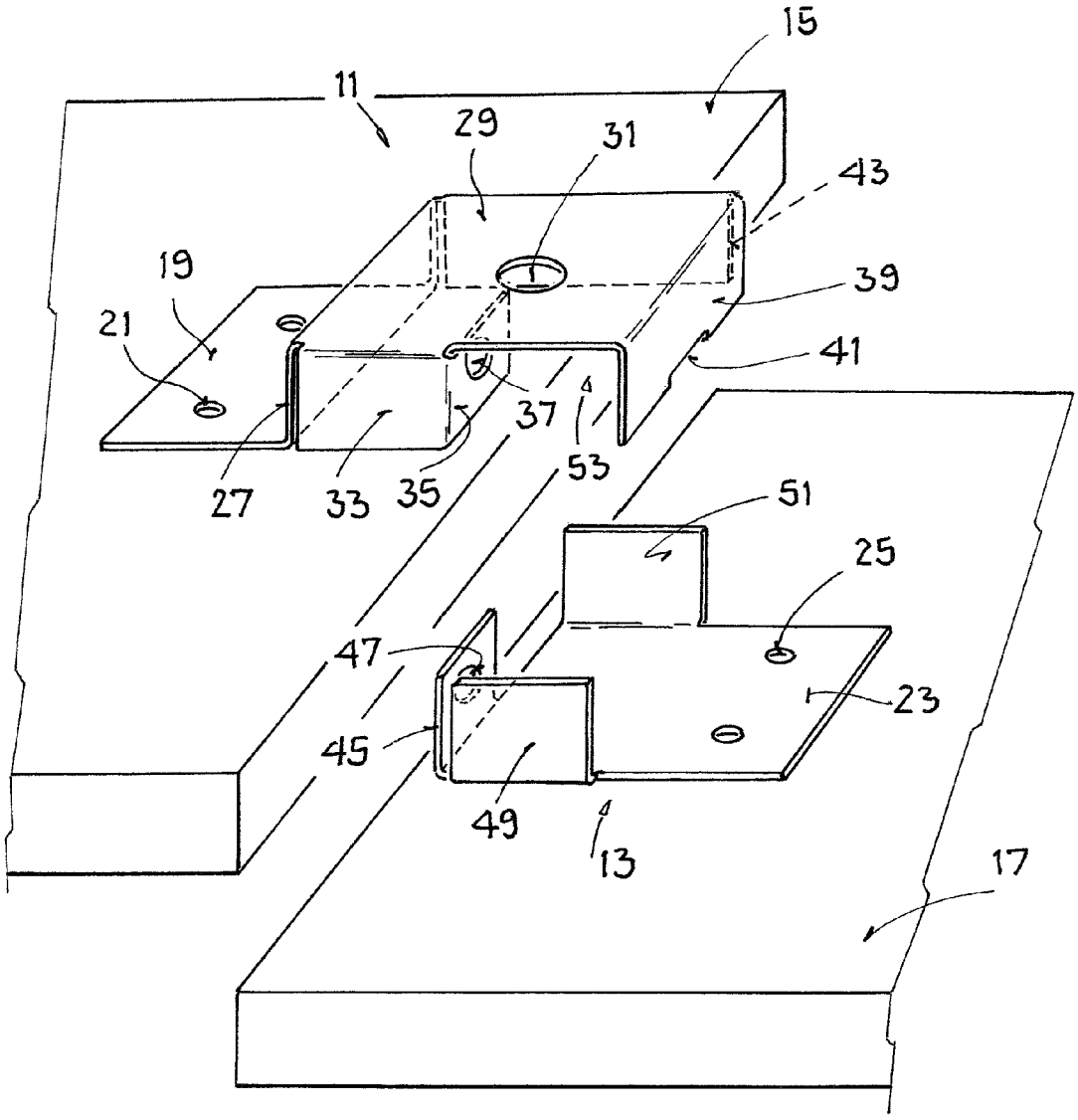

| | | | | |
|---|---|---|---|---|
| 5,878,604 | A * | 3/1999 | Stone et al. | 70/56 |
| 6,010,166 | A * | 1/2000 | Hamilton et al. | 292/282 |
| 6,357,266 | B1 * | 3/2002 | Van Buren | 70/56 |
| 6,463,769 | B1 * | 10/2002 | Garner | 70/56 |
| 6,601,413 | B1 * | 8/2003 | Vito | 70/56 |
| 6,622,533 | B1 * | 9/2003 | Santini | 70/56 |
| 7,210,316 | B1 * | 5/2007 | Falconer et al. | 70/2 |
| D561,005 | S * | 2/2008 | Rohde et al. | D8/345 |
| 2004/0011092 | A1 * | 1/2004 | Haczynski et al. | 70/23 |
| 2005/0006451 | A1 | 1/2005 | Taylor | |

OTHER PUBLICATIONS

ABUS Catalogue Lieferprogramm Ausgabe 90/91 (title page, imprint page, p. 38).

ABLOY Padlocks Product Catalogue (title page, p. 8, imprint page).

Master Lock Internet Product Information Steel Hasp No. 770.

Zone Security Internet Product Information Steel Hasp No. 4000/V.

* cited by examiner

LOCKING ARRANGEMENT

The invention relates to a locking arrangement for the latching of a door to a counterpart. The door can, for example, be a pivotable door wing or a sliding door. The named counterpart can, for example, likewise be formed by a pivotable door wing, a sliding door, a door frame or a building wall. Such a locking arrangement in particular serves as a retrofittable additional securing means to latch the rear doors of a delivery vehicle to one another. The locking arrangement is generally made in two parts for this purpose, with the one part being associated with the door and the other part being associated with the counterpart. When using a lock, the two parts can be secured to one another in order hereby to latch the door and the counterpart to one another. Any unauthorized opening of the door is hereby prevented. A hoop lock, in particular a so-called padlock, is suitable as the lock, for example.

Known locking arrangements of the named kind do not always provided the desired stability and security against being broken open or they are undesirably complex in manufacture and correspondingly expensive.

It is an object of the invention to provide a locking arrangement for the latching of a door to a counterpart which has a simple design and can be manufactured cost-effectively and which nevertheless provides high security against being broken open.

This object is satisfied by a locking arrangement which has an upper part and a lower part, with the upper part at least comprising:

- a base section with at least one fastening means which is provided at the base section or at a fastening section connected to the base section;
- a first side section which is connected to the base section and is angled with respect to the base section;
- a cover section which is connected to the first side section and is angled with respect to the base section; and
- a securing section which is angled with respect to the cover section and has a securing opening, with the lower part at least comprising:

- a base section with at least one fastening means which is provided at the base section of the lower part or at a fastening section connected to the base section of the lower part; and
- a securing section which is angled with respect to the base section and has a securing opening, wherein a holding means for the holding of a hoop lock is provided at the upper part or at the lower part;

wherein the upper part and the lower part can be positioned relative to one another in a position of use of the locking arrangement such that the securing opening of the upper part and the securing opening of the lower part are arranged in alignment to be able to secure the two securing sections to one another by means of a hoop lock; and wherein the cover section of the upper part has a key opening for a front-side introduction of a key.

Such a locking arrangement is characterized by an upper part and a lower part which can be fastened to the door and to the counterpart—or vice versa. Both the upper part and the lower part have a respective securing section with a securing opening, with the two securing sections being made such that the named openings are aligned in the position of use of the locking arrangement—that is when the door is closed relative to the counterpart. The two securing sections can thus be secured to one another by means of a hoop of an associated hoop lock in order hereby to latch the door and the counterpart to one another. The hoop lock can be covered by means of the cover section in this respect to protect the hoop lock from manipulation attempts. In addition, at least one side section can protect the hoop lock in the position of use of the locking arrangement from the side, in particular in the area of the lock hoop. Since, however, the lock opening is provided at the front-side cover section of the upper part, the major points of attack can already be protected by the cover section simply by covering the lock by means of the cover section of the upper part. The handling for the authorized user is also hereby simplified quite substantially.

The different base sections and side sections as well as the cover section can be formed by plate-like, i.e. flat, metal parts. The base section, the named first side section and the cover section of the upper part can in particular be formed by a single stamped/bent part, that is by a one-piece, folded sheet metal part, or the whole upper part and the whole lower part are even each formed by s single-part sheet metal part which is angled at a plurality of folds. A particularly stable locking arrangement which is simultaneously easy to manufacture and thus cost-effective hereby results.

The named hoop lock can be part of the locking arrangement. The hoop lock is preferably a rotatable hoop lock with a rotatable hoop shaped like the section of a circle. A shallow design of the locking arrangement hereby results despite the advantageous front-side operation (via the key opening at the cover section of the upper part).

An advantage of the invention lies in the fact that generally a commercial hoop lock can also be used, for example, the padlock of the type "Diskus" of ABUS August Bremicker Söhne K G, Wetter, Germany.

A further advantage of the invention lies in the fact that such a hoop lock can be permanently held at the upper part or at the lower part of the locking arrangement such that the lock also remains fastened to the upper part or to the lower part with an open lock hoop, in particular when the respective door is opened and the upper part and the lower part are separated from one another for this purpose. The handling of the locking arrangement is hereby facilitated in a advantageous manner since the associated hoop lock does not always have to be completely released and held or put down by the user, for example, for the latching and unlatching of the arrangement. In other words, the hoop lock can always remain fastened to the upper part or to the lower part—even if it is purchased as a separate article by the user—so that the user only has to take along the key associated with the lock, but not the lock itself if the door should remain unlatched temporarily.

It is preferred in this connection if the hoop lock has a latching mechanism with key retaining. In this case, the key associated with the lock can only be removed from the lock when the latching mechanism—and thus the lock hoop—has been brought into a latching position. The user can thus conclude without any further visual inspection simply from the circumstance that the key can be removed that the upper part and the lower part of the latching mechanism (naturally provided that it is in the position of use) are properly secured to one another. This is particularly advantageous since the cover section of the upper part—as explained—substantially covers the lock and the lock hoop is thus, for example, not easily visible.

Further advantageous and preferred embodiments are named in the dependent claims.

The invention will be explained only by way of example in the following with reference to the drawings.

FIG. 1*a* shows a perspective view of a first embodiment of a locking arrangement.

Figure 1B:
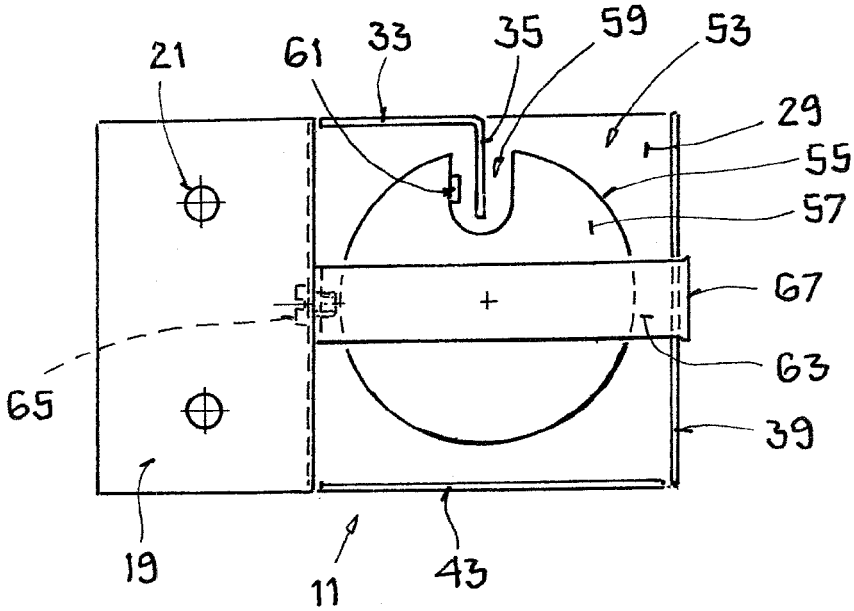

FIG. 1*b* shows the rear side of the upper part of the locking arrangement in accordance with FIG. 1*a* with a rotatable hoop lock fastened thereto.

FIGS. 2 to 5 show a respective perspective view of a second, a third, a fourth and a fifth embodiment of a locking arrangement.

Elements which are the same or of the same kind are marked by the same reference numerals in the Figures. Folds are shown by thin lines. The contour of hidden elements or of edges is partly drawn as a dashed line.

FIGS. 1*a* and 1*b* show a first embodiment of a locking arrangement with an upper part 11 and a lower part 13. The upper part 11 is provides for fastening to a door 15 (e.g. a first door wing). The lower part 13 is provided for fastening to a counterpart 17 (e.g. second door wing, door frame or building wall). For this purpose, the upper part 11 has a plurality of fastening openings 21 at a base section 19 through which fastening screws, fastening bolts, fastening rivets or the like can be led. Alternatively, fastening bolts can be permanently fastened, for example welded, to the lower side of the base section 19. In a corresponding manner, a plurality of fastening openings 25 are formed at a base section 23 of the lower part 13. The respective fastening means (fastening openings 21, 25) can also be formed at a respective fastening section which is connected to the base section 19 of the upper part 11 or to the base section 23 of the lower part 13 and is in particular angled, for example for fastening to a corresponding angled wall section.

A first side section 27 at which in turn a cover section 29 is shaped is shaped at the base section 19 of the upper part 11. The cover section 29 has a central key opening 31 for the introduction of a key of a rotatable hoop lock, as will still be explained in the following. A second side section 33 is shaped adjacent to the first side section 27 at the cover section 29 and extends approximately along half the respective side length of the cover section 29. A securing section 35 is in turn shaped at a side edge of this second side section 33 of the upper part 11 and has a securing opening 37 for the introduction of the hoop of the already named rotatable hoop lock. The rotatable hoop lock is not shown in FIG. 1*a* for reasons of better clarity.

A third side section 39 is additionally shaped at the cover section 29 of the upper part 11 opposite the first side section 27. Said third side section has a fastening cut-out 41 at its free longitudinal edge for a holding web described in the following. In addition, a fourth side section 43 (shown by a dashed line in FIG. 1*a*) is also shaped at the cover section 29—and indeed opposite the second side section 33.

The first side section 27 of the upper part 11 is angled orthogonally in each case with respect to the base section 19 and with respect to the cover section 29 so that the base section 19 and the cover section 29 extend in parallel offset to one another, with the base section 19 and the cover section 29 extending in opposite directions starting from the first side section 27. It is, however, alternatively possible that the base section 19 and the cover section 29 are angled in the same direction starting from the first side section 27, i.e. the base section 19 can also be arranged beneath the cover section 29.

The second side section 33 of the upper part 11 is likewise angled orthogonally to the cover section 29 and the securing section 35 is in turn angled orthogonally to the second side section 33 so that the securing section 35 of the upper part 11 extends substantially perpendicular to the cover section 29, and indeed along the rear side of the cover section 29. The third side section 39 is also angled at a right angle to the cover section and the fourth side section 43 is likewise angled orthogonally to the cover section 29. It must, however, be noted that the receiving space for the already mentioned rotatable hoop lock provided at the rear side of the cover section 29 does not have to be surrounded by side sections at all sides—i.e. not along the total periphery. The side sections 39 and 43 can therefore also be omitted in a simplified embodiment.

A securing section 54 is shaped at the already named base section 23 of the lower part 13, is angled at a right angle to the base section 23 and has a securing opening 47 for the introduction of the already named lock hoop.

In addition, a first side section 49 and a second side section 51 are each shaped orthogonally to the base section 23 at the base section 23 of the lower part 13. The first side section 49 ultimately serves for the closing of the aforesaid receiving space for the rotatable hoop lock. The second side section 51 of the lower part 13 cooperates as a placement aid with the fourth side section 43 of the upper part 11 and serves for the stabilization of the locking arrangement in the position of use.

FIG. 1*b* shows the rear side of the upper part 11. A rotatable hoop lock 55 is now fastened in the already named receiving space 53 provided at the rear side of the cover section 29. The rotatable hoop lock 55 has a lock body 57 with a cut-out 59. The rotatable hoop lock 55 can be rotatably actuated at the front side (not shown) by means of an associated key (likewise not shown) which is guided through the front-side key opening 31 (FIG. 1*a*). A curve-shaped rotatable hoop 61 can hereby selectively be moved out of the lock body 57 to pass through the cut-out 59 or the rotatable hoop 61 can be moved back into the lock body 57 from the cut-out 59. Alternatively to the use of a rotatable hoop lock 55 with a rotatable hoop 61, a different kind of hoop lock can generally also be used, for example with a linearly movable hoop or closing bolt.

The fastening of the rotatable hoop lock 55 to the upper part 11 takes place by means of a holding web 63. The holding web 63 extends in parallel offset to the cover section 29 of the upper part 11 between the first side section 27 and the third side section 39. It has an anchorage section 65 at one end which engages into an associated cut-out at the first side surface 27 of the upper part 11—and indeed adjacent to the base section 19. The anchorage section 65 can, for example, have a hang-in tongue or a fastening screw. At the other end, the holding web 63 has a wedge section 67, for example, which is jammed at the fastening cut-out 41 of the third side section 39 of the upper part 11. Other kinds of fastening are naturally also possible to hold the rotatable hoop lock 55 permanently (releasably or non-releasably) at the upper part 11.

The operation of the locking arrangement shown will be explained in the following: The door 15 can be pivoted at the height of the counterpart 17 to thereby bring the explained locking arrangement into a position of use. It can be recognized from FIG. 1*a* that the upper part 11 and the lower part 13 are then arranged with respect to one another in this position of use such that the securing opening 37 of the securing section 35 of the upper part 11 is also brought into alignment with the securing opening 47 of the securing section 45 of the lower part 13. With respect to the representation in accordance with FIG. 1*b*, this means that, in addition to the securing section 35 of the upper part 11, the securing section 45 of the lower part 13 is brought into the cut-out 59 of the lock body 57, provided that a rotatable hoop lock 55 of the explained kind is fastened to the upper part 11.

Provided that now the rotatable hoop 61 is brought by a corresponding actuation of the rotatable hoop lock 55 into a latching position in which the rotatable hoop 61 passes through the cut-out 59, the rotatable hoop 61 also engages through the two securing openings 37, 47 of the upper part 11 and of the lower part 13 so that the two securing sections 35, 45 are secured to one another and the upper part 11 and the lower part 13 are also secured to one another. The door 15 is thus latched to the counterpart 17.

The rotatable hoop 61 of the rotatable hoop lock 55 is again moved back out of the cut-out 59 for the unlatching of the locking arrangement by a corresponding actuation by means of the associated key so that the two securing sections 35, 45 of the upper part 11 and of the lower part 13 are released again and the upper part 11 can thus be released from the lower part 13.

In the described position of use of the locking arrangement, the cover section 29 of the upper part 11 covers the securing section 35 of the upper part 11 and also the securing section 45 of the lower side 13. In addition, the cover section 29 covers a substantial part of the front side of the rotatable hoop lock 55. In this position of use, the securing section 45 of the lower part 13 now also extends along the rear side of the cover section 29 of the upper part 11. The securing sections 35, 45 of the rotatable hoop 61 of the rotatable hoop lock 55 as well as the lock body 57 are hereby protected from manipulation attempts from the outside.

In the embodiment in accordance with FIGS. 1*a* and 1*b* the protection of the rotatable hoop lock 55 is particularly good since the receiving space 53 for the rotatable hoop lock 55 in the explained position of use of the locking arrangement is surrounded at all peripheral sides by side sections 27, 33, 39, 43 of the upper part 11 and by side sections 49, 51 of the lower part 13.

The explained locking arrangement can be manufactured in a particularly simple and cost-effective manner. Apart from the named rotatable hoop 61 of the rotatable hoop lock 55, no movable parts are namely required, i.e. the different sections 19, 27, 29, 33, 35, 39, 43 of the upper part 11 can be provided in a rigid arrangement relative to one another. The same applies accordingly to the lower part 13 with the sections 23, 45, 49, 51. The handling by the user is hereby also simplified since no movable parts have to be folded over and flipped over one another in a specific order, for example.

Above all, the different sections 19, 27, 29, 33, 35, 39, 43 of the upper part 11 and the different sections 23, 45, 49, 51 of the lower part 13 can be made as plate-like metal sections so that a particularly simple processing is possible and the upper part 11 and the lower part 13 can be made at least in part as a respective one-piece folded sheet metal part. The sections 19, 27, 29, 33, 39 and 43 can in particular form a single stamped/bent part, with the individual sections only being folded over to form a respective adjacent section at the connection line (cf. thinly drawn fold in FIG. 1*a*). The securing section 35 of the upper part 11 can likewise be shaped in one piece at such a stamped/bent part. Alternatively, it is, however, also possible, for example, to form the securing section 35 with the securing opening 37 as an eyelet which is fastened—e.g. welded—to the rear side of the cover section 29 of the upper part 11, with the securing section 45 also being able to be made with the securing opening 47 as an eyelet which is fastened—e.g. welded—to the base section 23 of the lower part 13. It is generally also possible that the different plate-like sections 19, 27, 29, 33, 35, 39, 43 of the upper part 11 and the different plate-like sections 23, 45, 49, 51 are fastened to one another as separate elements by welding, for example.

A further advantage lies in the fact that the locking arrangement can cooperate with a commercial hoop lock. The rotatable hoop lock 55 can therefore be a fixed component of the locking arrangement. Alternatively, the user can, however, also use the upper part 11 and the lower part 13 in conjunction with another hoop lock of his choice.

Overall, a locking arrangement of high stability and security against being broken open results which can simultaneously be manufactured in a cost-effective manner and can be fastened in a simple manner. The locking arrangement is hereby also particularly well suited for retrofitting at a door 15 and a counterpart 17.

Numerous modifications of the embodiment in accordance with FIGS. 1*a* and 1*b* are naturally possible. For example, an orthogonally angled fifth side section can also be provided at the third side section 39 of the upper part 11 in accordance with FIG. 1*a*, did firth side section extending adjacent to the cover section 29 in the direction of the second side section 33 to close the gap visible in FIG. 1*a*. In this case, the first side section 49 of the lower part 13 can be omitted so that the lower part 13 ultimately only has to have the securing section 45 with securing opening 47. Conversely, the side sections 39 and 43 of the upper part 11 and the side sections 49 and 51 of the lower part 13 can also be completely omitted. Even the second part section 33 of the upper part 11 can be omitted if the securing section 35 is fastened as a separate part—for example as an eyelet—to the rear side of the cover section 29 of the upper part 11.

Different possible variants will be described by way of example in the following.

Figure 2:
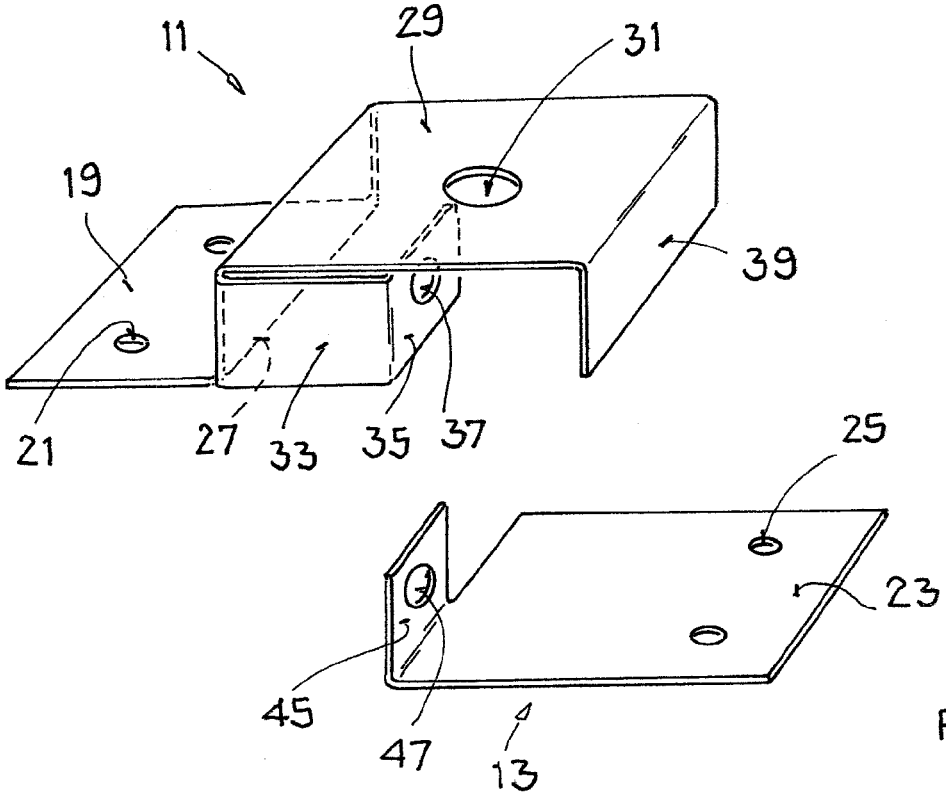

FIG. 2 shows an embodiment in which the second side section 33 of the upper part 11 is shaped at the first side section 27 (and not at the cover section 29). The lower part 13 only has the securing section 45, but no further side sections.

Figure 3:
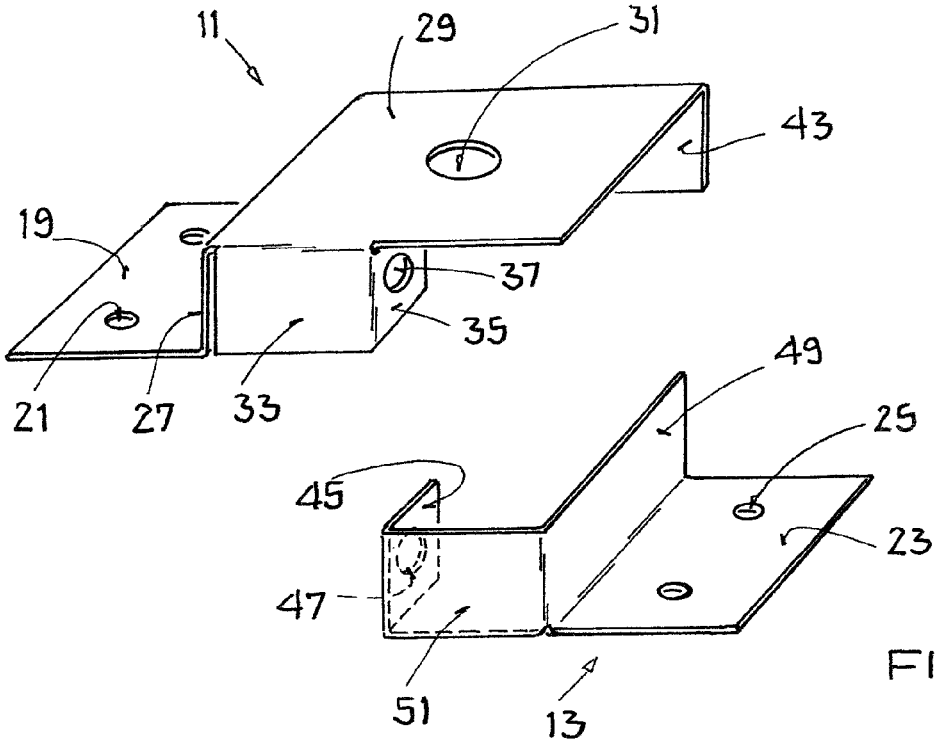

FIG. 3 shows an embodiment in which the upper part 11, unlike the embodiment in accordance with FIGS. 1*a* and 1*b*, has no third side sections 39. The lower part 13, in contrast, has a first side section 49 shaped at the base section 23 and a second side section 51 shaped thereat, with the securing section 45 of the lower part 13 being shaped at the second side section 51.

Figure 4:
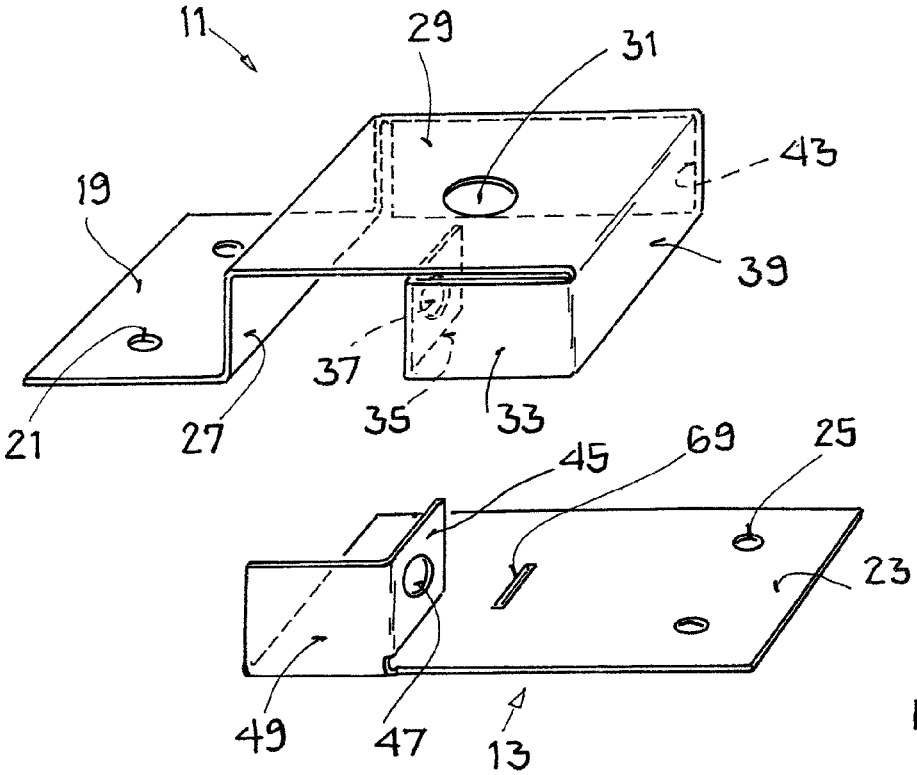

In the embodiment in accordance with FIG. 4, the second section 33 supporting the securing section 35 is shaped at the third side section 39 of the upper part 11. The securing section 45 of the lower part 13 is shaped at the first side section 49 of the lower part 13 which is in turn shaped at the base section 23 of the lower part 13. This first side section 49 extends perpendicular to the base section 23 of the lower part 13.

FIG. 4 additionally shows a fastening slot 69 at the base section 19 of the lower part 13. Such a fastening slot 69 makes it possible, while using a metal belt or plastic belt, for example, to fix the respective hoop lock (e.g. rotatable hoop lock 55) at the lower part 13. Further fastening slots can also be provided for this purpose. This type of fastening is naturally also possible if the hoop lock—as explained in connection with FIGS. 1*a* and 1*b*—should be fastened at the upper part 11.

Figure 5:
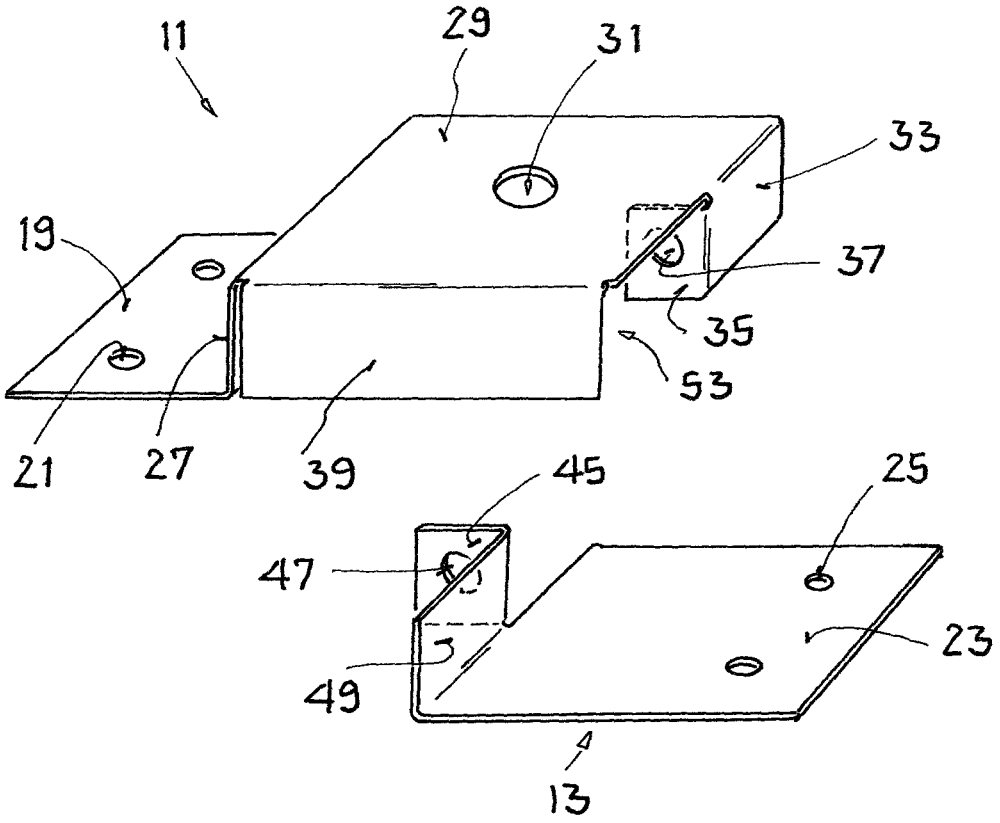

FIG. 5 shows an embodiment in which the second side surface 33 is arranged with the securing section 35 disposed oppositely to the first side surface 27 of the upper part 11. The securing section 45 of the lower part 13 is in turn fastened to the base section 23 of the lower part 13 via a first side section 49 such that in the position of use of the locking arrangement the securing opening 37 of the securing section 35 and the securing opening 47 of the securing section 45 are arranged in alignment. It can be see from FIG. 5 that this embodiment is also suitable for sliding doors. The upper part 11 provided with a hoop lock 11 can therefore be moved from this side in the direction of the lower part 13 to bring the securing sections 35, 45 into coincidence.

REFERENCE NUMERAL LIST

11 upper part
13 lower part

15 door
17 counterpart
19 base section of 11
21 fastening opening
23 base section of 13
25 fastening opening
27 first side section of 11
29 cover section
31 key opening
33 second side section of 11
35 securing section of 11
37 securing opening
39 third side section of 11
41 fastening cut-out
43 fourth side section of 11
45 securing section of 13
47 securing opening
49 first side section of 13
51 second side section of 13
53 receiving space
55 rotatable hoop lock
57 lock body
59 cut-out
61 rotatable hoop
63 holding web
65 anchoring section of 63
67 wedge section of 63
69 fastening slot

The invention claimed is:

1. A locking arrangement, comprising:

an upper part attached to one of a door or a counterpart;

a lower part attached to the other of the door or the counterpart; and a hoop lock having a moveable hoop, wherein the upper part comprises:

a base section having fastening means which rigidly fastens the base section or a fastening section connected to the base section to the one of door or the counterpart;

a first side section which is connected to the base section and is angled with respect to the base section;

a cover section which is connected to the first side section and is angled with respect to the first side section; and a securing section which is angled with respect to the cover section and has a securing opening;

wherein the lower part comprises:

a base section having fastening means which rigidly fastens the base section of the lower part or a fastening section connected to the base section of the lower part to the other of the door or the counterpart; and a securing section which is angled with respect to the base section of the lower part and has a securing opening;

wherein a holding means is rigidly fixed to the upper part or the lower part to hold the hoop lock;

wherein the upper part and the lower part can be positioned relative to one another in a position of use of the locking arrangement such that the securing opening of the upper part and the securing opening of the lower part are arranged in alignment to be able to secure the two securing sections to one another by means of the hoop when the hoop lock is closed;

wherein the cover section of the upper part has a key opening for a front-side introduction of a key; and wherein the holding means is adapted to permanently hold the hoop lock at the upper part or at the lower part both when the upper part and the lower part are brought into the position of use and when the upper part and the lower part are brought into positions displaced from one another and even when the hoop lock is open.

2. The locking arrangement in accordance with claim 1, wherein the cover section of the upper part in the position of use of the locking arrangement covers the securing section of the upper part and the securing section of the lower part.

3. The locking arrangement in accordance with claim 1, wherein the securing section of the upper part substantially extends perpendicular to the cover section.

4. The locking arrangement in accordance with claim 1, wherein the securing section of the lower part extends substantially perpendicular to the base section of the lower part.

5. The locking arrangement in accordance with claim 1, wherein the securing section of the upper part extends along a rear side of the cover section of the upper part.

6. The locking arrangement in accordance with claim 5, wherein the securing section of the lower part in the position of use of the locking arrangement likewise extends along the rear side of the cover section of the upper part.

7. The locking arrangement in accordance with claim 1, wherein the base section and the cover section of the upper part extend parallel to one another.

8. The locking arrangement in accordance with claim 1, wherein the base section and the cover section of the upper part extend in opposite directions starting from the first side section of the upper part.

9. The locking arrangement in accordance with claim 1, wherein the securing section of the upper part substantially extends perpendicular to the cover section.

10. The locking arrangement in accordance with claim 1, wherein the upper part furthermore has a second side section to which the securing section of the upper part is connected, with the second side section being connected to the first side section, to the cover section or to a third side section connected to the cover section, and wherein the second side section is angled with respect to the cover section.

11. The locking arrangement in accordance with claim 10, wherein the second side section of the upper part substantially extends perpendicular to the cover section.

12. The locking arrangement in accordance with claim 1, wherein the upper part has a side section which is connected to the cover section of the upper part disposed opposite the first side section of the upper part and extends substantially perpendicular to the cover section.

13. The locking arrangement in accordance with claim 12, wherein the first side section of the upper part and the side section of the upper part arranged opposite to the first side section of the upper part project from the cover section of the upper part in the same direction to form a housing closed on at least three sides for the reception of the hoop lock.

14. The locking arrangement in accordance with claim 12, wherein the holding means has a holding web which extends in parallel offset to the cover section of the upper part between the first side section of the upper part and the side section of the upper part disposed opposite the first side section of the upper part.

15. The locking arrangement in accordance with claim 1, wherein the lower part has a first side section which is connected to the base section of the lower part and is angled with respect to the base section of the lower part, and wherein the securing section of the lower part is connected to the first side section of the lower part or to a second side section of the lower part, which second side section is connected to the first side section of the lower part.

16. The locking arrangement in accordance with claim 15, wherein the securing section of the lower part extends substantially perpendicular to the base section of the lower part.

17. The locking arrangement in accordance with claim 1, wherein in the position of use of the locking arrangement the cover section of the upper part and the base section of the lower part extend parallel to one another.

18. The locking arrangement in accordance with claim 1, wherein the movable hoop which in the position of use of the locking arrangement can be introduced into the securing opening of the upper part and into the securing opening of the lower part to secure the two securing sections to one another when the hoop is moved to a closed position and engages a lock body of the hoop lock.

19. The locking arrangement in accordance with claim 18, wherein the hoop lock is permanently fastened to the upper part or the lower part, and the hoop lock is made as a rotatable hoop lock with a rotatably movable lock hoop.

20. The locking arrangement in accordance with claim 18, wherein the hoop lock has a latching mechanism with key retaining.

21. The locking arrangement in accordance with claim 18, wherein in the position of use of the locking arrangement the cover section of the upper part covers a front side of the hoop lock at least in part.

22. The locking arrangement in accordance with claim 18, wherein the upper part and the lower part have a plurality of side sections which in the position of use of the locking arrangement enclose a receiving space within which the hoop lock is located.

23. The locking arrangement in accordance with claim 1, wherein the securing section of the upper part extends transversely relative to the first side section of the upper part such that pivotal movement of the door relative to the counterpart causes the securing section of the upper part to be aligned in parallel to and in close proximity with the securing section of the lower part.

24. The locking arrangement in accordance with claim 1, wherein the sections of the upper part and the sections of the lower part are made in plate-like form.

25. The locking arrangement in accordance with claim 1, wherein the sections of the upper part are provided in a rigid arrangement relative to one another and wherein the sections of the lower part are provided in a rigid arrangement relative to one another.

26. The locking arrangement in accordance with claim 1, wherein at least the base section, the first side section and the cover section of the upper part are formed by a one-piece folded sheet metal part.

27. The locking arrangement in accordance with claim 1, wherein the upper part and the lower part are each formed by a one-piece folded sheet metal part.

28. The locking arrangement in accordance with claim 1, wherein the fastening means of the base section of the upper part or of the base section of the lower part includes a fastening opening or a fastening bolt.

29. A locking arrangement for latching a door to a counterpart, the locking arrangement comprising:

a first part having a base section adapted to be rigidly fixed to the door, a first side section connected to said base section, a cover section connected to said first side section, a second side section connected to one of said first side section and said cover section, and a securing section connected to said second side section and having a securing opening, wherein said first side section, said cover section and said second side section are configured to define a receiving space with said securing section extending into said receiving space;

a second part having a base section adapted to be rigidly fixed to the counterpart and a securing section connected to said base section and including a securing opening;

a lock unit having a key-operated latching mechanism and a moveable lock member, said lock unit being disposed within said receiving space defined by said first part; and a holder for securing said lock unit to said first part, wherein said first part and said second part can be positioned relative to one another in a position of use of the locking arrangement such that said securing opening of the first part and said securing opening of said second part are brought into alignment to be able to releaseably latch said first and second securing sections to one another by movement of said moveable lock member of the lock unit through said aligned securing openings to a closed position, and wherein a key opening in said cover section of said first part permits introduction of a key to operate said key-operated latching mechanism to release said lock member and allow movement thereof to an open position such that said first part can be subsequently moved relative to said second part.

30. The locking arrangement of claim 29 wherein said lock unit is a hoop lock having a rotatably moveable hoop as said lock member, and wherein said holder secures said hoop lock within said receiving space to at least one of said first side section and said cover section.

31. The locking arrangement of claim 29 wherein said securing section of said first part is aligned to be generally parallel to said first side section of said first part to facilitate pivotal movement of the door relative to the counterpart for moving said securing section of said first part relative to said securing section of said second part, and wherein said securing section of said second part is configured to be parallel to said securing section of said first part.

32. The locking arrangement of claim 29 wherein said securing section of said first part is aligned to be generally orthogonal to said first side section of said first part to facilitate sliding movement of the door relative to the counterpart for moving said securing part of said first part relative to said securing part of said second part, and wherein said securing section of said second part is configured to be parallel to said securing section of said first part.

33. A locking arrangement for latching a door to a counterpart, the locking arrangement comprising:

a first part having a base section adapted to be rigidly fixed to the counterpart, a first side section connected to said base section, a cover section connected to said first side section, a second side section connected to one of said first side section and said cover section, and a securing section connected to said second side section and having a securing opening, wherein said first side section, said cover section and said second side section are configured to define a receiving space with said securing section extending into said receiving space;

a second part having a base section adapted to be rigidly fixed to the door and a securing section connected to said base section and including a securing opening;

a lock unit having a key-operated latching mechanism and a moveable lock member, said lock unit being disposed within said receiving space defined by said first part; and a holder for securing said lock unit to said first part, wherein said first part and said second part can be positioned relative to one another in a position of use of the locking arrangement such that said securing opening of said first part and said securing opening of said second part are brought into alignment to be able to releaseably latch said first and second securing sections to one another by movement of said moveable lock member of said lock unit through said aligned securing openings to a closed position, and wherein a key opening in said cover section of said first part permits introduction of a key to operate said key-operated latching mechanism to release said lock member and allow movement thereof to an open position such that said first part can be subsequently moved relative to said second part.

* * * * *